United States Patent [19]

Chambley et al.

[11] 4,215,642

[45] Aug. 5, 1980

[54] VARIABLE TWIST SELF-TWIST YARN

[75] Inventors: Phillip W. Chambley; Alan H. Norris, both of Rome, Ga.

[73] Assignee: WWG Industries Inc., Rome, Ga.

[21] Appl. No.: 844,616

[22] Filed: Oct. 25, 1977

[51] Int. Cl.[2] ..... D05C 17/02; D02G 3/26

[52] U.S. Cl. ..... 112/410; 57/204; 57/205; 57/293

[58] Field of Search ..... 57/139, 140, 156, 34 AT, 57/204, 205, 293, 294; 112/410

[56] References Cited

U.S. PATENT DOCUMENTS

| | | | |
|---|---|---|---|
| 3,225,533 | 12/1965 | Henshaw | 57/34 AT |
| 3,306,023 | 2/1967 | Henshaw et al. | 57/156 |
| 3,434,275 | 3/1969 | Backer et al. | 57/156 X |
| 3,488,939 | 1/1970 | Walls | 57/139 |
| 3,537,251 | 11/1970 | Kimura et al. | 57/34 AT X |
| 3,717,988 | 2/1973 | Walls | 57/34 AT |
| 3,775,955 | 12/1973 | Shah | 57/34 AT |
| 4,055,039 | 10/1977 | Movshovich et al. | 57/34 AT |
| 4,068,459 | 1/1978 | Movshovich et al. | 57/34 AT X |
| 4,084,400 | 4/1978 | Movshovich et al. | 57/34 AT X |

*Primary Examiner*—John Petrakes

*Attorney, Agent, or Firm*—Beveridge, DeGrandi, Kline and Lunsford

[57] ABSTRACT

A stable plied yarn is produced by false-twisting two or more singles yarn strands with false-twist jets and passing the strands around a yarn wheel whereon the nodes are joined. The strands leave the wheel and ply together. The plied yarn is collected and can be tufted into carpet. The pressure of the fluid (air) supplied to the false-twist jets is varied to product varying amounts of twist in the singles strands which results in a range of twist amounts in the yarn plied therefrom, thereby avoiding streak effects in products made from the yarn.

6 Claims, 8 Drawing Figures

VARIABLE TWIST SELF-TWIST YARN

BACKGROUND OF THE INVENTION

The concept of producing plied yarns using the false-twist, self-twist phenomenon are now rather well known in the art. Documents in which the general principles of false-twisting and self-twisting are described include the following:

"Self-Twist Yarn," D. E. Henshaw, Merrow Publishing Co., Ltd., Watford, Herts, England, 1971

U.S. Pat. No. RE 27,717—Breen et al.
U.S. Pat. No. 3,225,533—Henshaw
U.S. Pat. No. 3,306,023—Henshaw et al.
U.S. Pat. No. 3,353,344—Clendening, Jr.
U.S. Pat. No. 3,434,275—Backer et al.
U.S. Pat. No. 3,507,108—Yoshimura et al.
U.S. Pat. No. 3,717,988—Walls
U.S. Pat. No. 3,775,955—Shah
U.S. Pat. No. 3,940,917—Strachan For purposes of convenience, some general comments concerning producing plied yarn by these techniques will be described. It is possible to form a plied yarn by false-twisting two or more singles yarn strands, attaching the strands to each other and then permitting the strands to wrap about each other using the release of forces stored by the false-twisting to accomplishing the plying, hence the term "self-twist". The false-twisting itself, in simplified form, involves holding spaced points of a yarn strand and twisting the strand in one direction at a point intermediate the held points, e.g., the center. This produces twists on one side of the center in one direction and on the other side of the center in the opposite direction. The center of the twisted strand constitutes a point of twist reversal and is called a "node". Clearly, forces are stored in the strand in the twisting step. When two strands similarly false-twisted are brought together in side-by-side juxtaposition and permitted to act against or with each other by releasing the nodes, the stored forces cause the strands to ply, i.e., to wrap around each other spontaneously. The process is enhanced and the product made more stable if the nodes of the two strands are aligned and are joined or locked together before release and plying.

As will be recognized, the torque or twist force exerted by each strand is roughly proportional to the amount of twist therein and that such force decreases as the strands ply. The plying step itself therefore continues until the stored twist forces in each strand decrease to a point at which the remaining twist forces are exactly counterbalanced by the resistance to further twisting in the plied yarn. Thus, if one begins with individual strands and then false twists the strands and plies them, each strand will end up, in the plied yarn, with some degree of false-twist which can be thought of as some remaining stored potential energy, the force exerted thereby being too small to cause further ply twisting against opposing frictional forces in the plied yarn. The resulting degree of ply twist is thus proportional to the amount of false twist imparted to the singles yarns.

An apparatus for false-twisting and node fastening and plying singles yarn strands is fully described in U.S. patent application Ser. No. 755,671, filed Dec. 30, 1976, now U.S. Pat. No. 4,074,511, wherein a rotatable guide member receives the false-twisted yarn and fastens the nodes thereof using a rotating contact device carried by the guide member.

As described in that application, and as partly shown in FIG. 1, the apparatus for forming and initially false-twisting the strands, the system commences with the yarn strands being withdrawn from sliver containers 10 and 11, the yarn strands 12 and 13 being subjected to a drafting or drawing process by pulling the yarns between drafting rolls, yarn 12 being drawn by drafting rolls 14 and 15 and yarn 13 being drawn by rolls 16 and 17. Roll 15 is typically driven at a surface velocity greater than that of roll 14 and roll 17 is driven at a surface velocity greater than roll 16. The yarns can then be passed through primary twist jets, yarn 12 being passed through jet 18 and yarn 13 being drawn through jet 19. The primary twist jets operate to impart and maintain twist at the critical point where the otherwise flat sliver ribbon leaves the draft delivery rolls. Yarn strand 12 is then passed through a singles-twist jet 20 and yarn 13 is then passed through a singles-twist jet 21 wherein the false-twist is inserted in the yarn strands. Air pressure under the control of apparatus not shown in FIG. 1 is supplied to false-twist jets 20 and 21 through conduits 22 and 23, respectively.

The control apparatus for the air supplied to jets 20 and 21 may be fluidic valves, electrical valves or mechanically operated valves which alternately supply fluid under pressure to the conduits of the false-twist jets so that the singles strands are sequentially twisted alternately in S and Z directions. It should be noted at this stage that jets 20 and 21 are paired to twist the yarn strands in the same direction as each other and are operated to periodically reverse the direction of twist to result in producing a yarn wherein there are opposite senses of twist separated by short nodes of zero twist, which nodes are in synchronization with the yarn wheel which bears a fixation device so that the nodes appear at the surface of the fixation disc at the appropriate time. Thus, yarn strands 12 and 13 emerge from jets 20 and 21 with alternating S and Z portions of twist therein.

The strands are then passed through a wire guide which can constitute a single elongated wire guide 24, or which can include separate wire guides associated with jets 20 and 21. The wire guide in either form assists in maintaining the singles twist in the yarn strands and serves the purpose of bringing the yarn into a relatively closely spaced relationship, preferably not in contact with each other. The yarns are guided onto a yarn wheel indicated generally at 24, the details of which will be described hereinafter. Yarn wheel 25 serves the function of guiding the yarns in parallel spaced relationship with each other, fixing the yarns at their nodes by means of a rotating fixation device, along with appropriate guides.

After the yarn has been twisted and the nodes locked on yarn wheel 25, the yarn 27 is passed around an idler roller 28, the singles yarns plying or self-twisting together at they leave the yarn wheel 25. If desired, the plied yarn can be passed through a heatset tube 29 and a further idler roller and then collected as indicated at 30.

The yarn wheel, which is also shown in application Ser. No. 755,671 and which is usable in the apparatus of FIG. 1, is illustrated in FIGS. 2 and 3 and includes a generally disc-shaped member having flanges 35 and 36 at the axial limits thereof and a central, separatory flange 37, the three flanges defining peripheral surface portions 38 and 39 along which yarn strands can be separately guided. Although wheel 25 is shown as having a single central, separatory flange 37, additional separatory flanges may be provided depending upon the number of singles yarns being plied. The number of separatory flanges will always be one less than the numbers of singles yarns being plied. Central flange 37 is interrupted at 40 to permit the strands to come into close proximity with each other and also to come in contact with the contacting surface of the fixation device which, in the illustrated embodiment, is an abrasion disc 41 which is rotated about an axis generally perpendicular to the axis of rotation of the yarn wheel and at a relatively high speed, on the order of 8,000 rpm. Typically, the disc can be driven by an electric motor which is mounted in the yarn wheel and to which DC voltage is supplied by means of a brush and slip ring combination, not shown. Regardless of the number of separatory flanges 37 utilized, each singles yarn must be brought into contact with other singles yarn on the disc 41 by suitable channeling means, one embodiment of which is illustrated at 42 in FIG. 2.

As further shown in FIG. 3, the channeling means can include guide portions 42*a* and 42*b* which serve to deposit the yarn directly on the surface of the fixation disc 41 and also serve to maintain the yarn on the disc long enough to fix the nodes. The disc can be driven by an electrical motor having an output shaft 43. Although FIG. 2 illustrated a wheel 25 having a single rotation means 41, such wheel can be provided with a plurality of such fixation means distributed around the wheel, it being understood that each such fixation means should be positioned to contact a node.

False-twist jets suitable for use in the system of FIG. 1 are shown in FIGS. 4 and 5, these also being disclosed in the aforementioned application.

As shown therein, each jet includes a body 50 having a central bore 51 with tangential orifices 52 and 53 intersecting the bore at diametrically opposite sides thereof. Two such jet inlets are provided to permit control of twist in either direction, as by alternately supplying the orifices with air under pressure. Air is supplied through conduits 54 or 55, which conduits are held in place by mounting means such as a plate 56 to which the conduits are attached, the plate being attached to the jet as by screws or similar fastening means 57.

Annular inserts 58 and 59 are provided at opposite ends of bore 51, each insert having an outer diameter equal to the inner diameter of the bore so that the inserts are slidably received therein. Each insert has an interior axial bore 60 of a smaller size than the bore 51, bores 60 being of a suitable size to permit the yarn to longitudinally pass therethrough. Body 50 is provided with internally threaded radially extending bores 61 and 62 which receive set screws 63 and 64, respectively. Bores 61 and 62 extend from the outer surface of the body into bore 51 so that, when inserts 58 and 59 are present, the set screws engage the inserts and hold them in place. Thus, for any given set of circumstances, the inserts can be axially adjusted and then locked in place using the set screws.

By adjustment of the inserts inwardly toward the jet orifices, a position can be established at and beyond which jet will operate in a filming mode on a particular yarn size, substantially regardless of the tension of the thread line. This is due to the fact that the jet orifices are always effectively outside the yarn arc turning radius, the air film resulting from the orifices being recessed radially beyond the insert bores producing a thicker air film. With this structure, the tangential relationship of the orifices 52 and 53 relative to bore 51 is not nearly so critical as in convenient vortex jets. However, it is preferred that the orifices be tangential to bore 51. Jets fabricated as described have been known to develop the same direction twist in yarns with no tension whatsoever and on those strained almost to the point of breakage.

In the manufacture of carpet using yarn manufactured on machines incorporating the features described in connection with FIGS. 1–5, it is common practice to produce yarn on several such machines for supply to a single carpet machine. This is done because of relative production rates and also because of color selection.

It has been found, however, that it is extremely difficult to produce yarns on several spinning machines in such a way that all of the yarns are exactly alike. The twist jets and/or air supplies in different spinning machines can be different enough so that the degree of twist differs in the finished yarns. When these yarns from different machines are tufted into the same carpet which can have, for example, 1,000 yarns in a 12 foot carpet width, these relatively small differences can show up as a streak effect in the final carpet. Thus, if one yarn has a different appearance from its neighbor in a tuft row, and if this appearance is continued row after row, the result is a line or streak warpwise in the carpet which is visually readily apparent, degrading the appearance of the carpet and such carpet is a "second".

BRIEF SUMMARY OF THE INVENTION

Briefly described, a product in accordance with the invention comprises, in a yarn of the type having a plurality of false-twisted singles yarns self-twisted together to form a plied yarn with longitudinally spaced nodes of zero twist defining longitudinally distinct plied yarn segments, the improvement wherein the amount of self-twist differs from segment to segment along the plied yarn over a predetermined range of amounts of twist.

The invention also contemplates a method of forming a yarn, particularly for use in carpet, comprising the steps of forming a pluraity of singles yarns, imparting false twist to each of the singles yarns by alternately rotating each of the yarns through a predetermined number of turns about its own axis to form, in each yarn, a plurality of longitudinally separated segments of alternating S and Z twist separated by zero twist nodes, varying the predetermined number of turns from segment to segment as the false twist is imparted to each yarn, joining the plurality of yarns at longitudinally spaced points in contiguous side-by-side relationship with segments of like twist being substantially aligned with each other, and causing the yarns to ply together to form a self-twisted yarn wherein the degree of self-twist varies from segment to segment along the length of the yarn.

The invention also includes an apparatus for forming an improved self-twisted yarn comprising means for forming a singles yarn strands, means for substantially continuously moving the yarns longitudinally, means for imparting false twist to each of the yarns by alternately twisting the yarns in S and Z directions as the yarns are longitudinally moved therethrough to form segments of false-twisted yarn separated by nodes of zero twist, means for controlling the means for imparting false twist to impart varying degrees of twist in the segments, and means for placing the singles yarns in contiguous relationship and for causing the yarns to ply together to form a self-twisted yarn.

In order that the manner in which the various objects are attained in accordance with the invention can be understood in detail, particularly advantageous embodiments thereof will be described with reference to the accompanying drawings, which form a part of this specification, and wherein.

Figure 6:
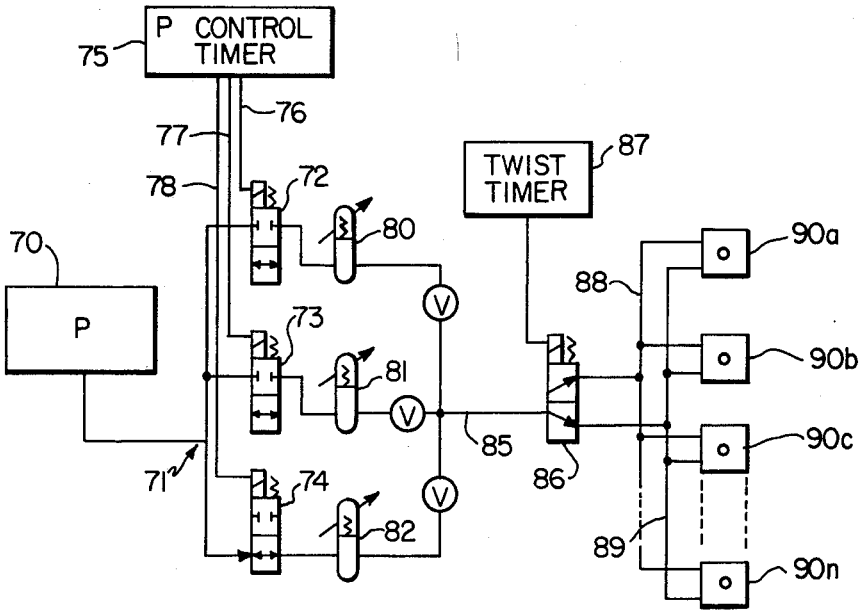
FIG. 6 is a schematic diagram, partly in block form, of a fluid pressure control system in accordance with the invention.

As seen in FIG. 6, a fluid pressure control apparatus in accordance with the invention includes a source 70 of fluid under pressure, which fluid would normally be air. Source 70 can include, for example, an air compressor and a conventional tank for maintaining the air at a desired pressure. Source 70 is connected to a conduit and manifold indicated at 71 which is connected to a plurality of valves such as valves 72, 73 and 74. Each of valves 72–74 is a two-position valve which is solenoid operated and can be spring returned so that when the solenoid thereof is energized, the valve moves to a position such as shown for valve 74 wherein fluid under pressure is coupled through the valve. When the solenoid is deenergized, the spring returns the valve to the positions shown for valves 72 and 73 wherein fluid is prevented from passing therethrough. A pressure control timing mechanism 75 is provided to sequentially provide electrical signals on conductors 76, 77 and 78, these conductors being connected respectively to the solenoids of valves 72, 73 and 74. Timer 75 can be, for example, and electronic timing device or an electromechanical device or a fluid-actuated electrical signal generator, the only requirement being that the timer provide energizing signals to the solenoids in a predetermined sequence.

Adjustable fluid pressure regulators 80, 81 and 82 are connected by conduits to the outputs of valves 72–74, respectively, the fluid pressure regulators being illustrated as adjustable spring-urged regulators which can be set to provide, at their outputs, a supply of air at three different pressures which can be selected in accordance with the operating conditions of the twist jets to be used therewith. Typically, regulators 80—80 can be set to deliver air in a pressure range of from 10 to 60 psig. The outputs of regulators 80, 81 and 82 are connected, through check valves, to a common conduit 85 which is connected to a two-position valve 86. Valve 86 is also a two-position valve, and is solenoid actuated and spring returned, the energizing signal for the solenoid thereof being provided by a twist timer unit 87. Timer unit 87 is operated to time the length of twist segments and can be any suitable timing device. Valve 86 and timer 87 can be modified, if desired, by making the valve a three-position valve with spring centering and with two solenoid coils and the timer can be of a type which produces a signal to one solenoid followed by a relatively brief delay which is followed by a signal to the other solenoid. This permits an interval of no output from valve 86 between the outputs from the two positions thereof.

Figure 1:
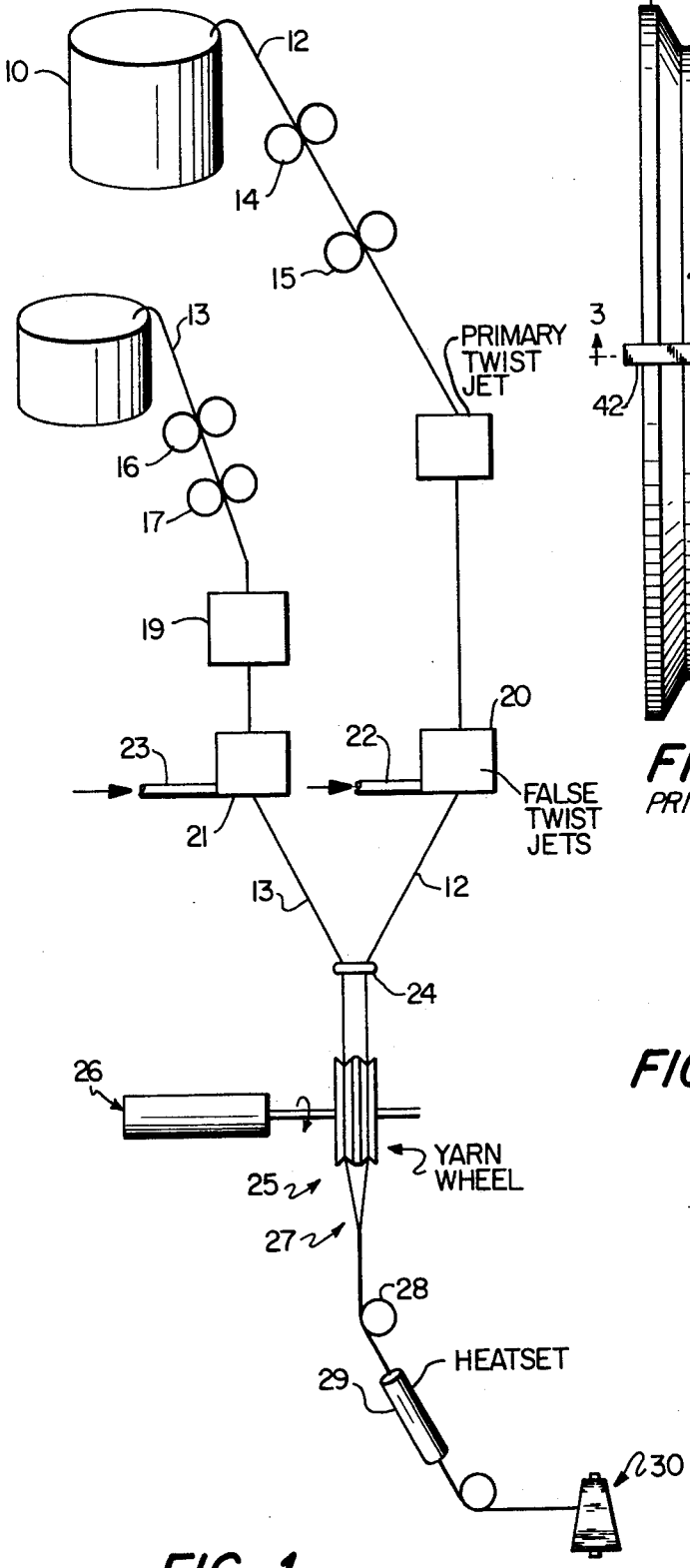
FIG. 1 PRIOR ART
FIG. 1 is a schematic diagram of an apparatus with which the present invention can be used.
Figure 2:
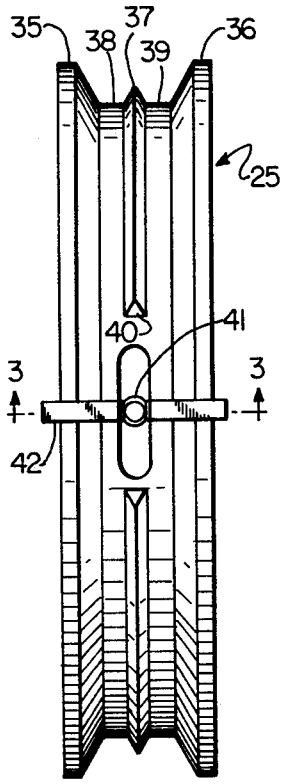
FIG. 2 PRIOR ART
FIGS. 2 and 3 are front elevation and sectional views, respectively, of a yarn wheel usable in the apparatus of FIG. 1.
Figure 3:
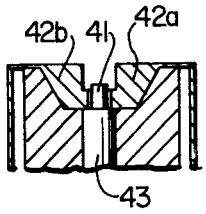
FIG. 3 PRIOR ART
Figure 4:
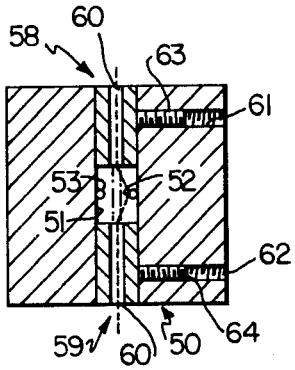
FIGS. 4 and 5 are sectional and plan views, respectively, of a twist jet usable in the apparatus of FIG. 1 in accordance with the invention.
Figure 5:
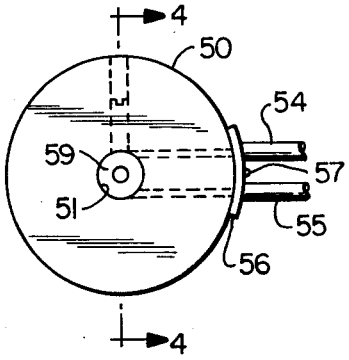

The two outputs of valve 86 are provided on conduits 88 and 89, conduits 88 and 89 being connected to one input of each of a plurality of twist jets 90*a–n*. Four twist jets are illustrated in FIG. 6, but it will be understood that as few as two twist jets may be used, the upper limit being determined by the practical number of strands to be twisted and plied together. It will be observed that conduit 88 is connected to the equivalent to conduit 55 in the twist jet shown in FIGS. 4 and 5, while conduit 89 is connected to the equivalent of conduit 54 shown therein, the conduits being positioned to control the direction of rotation and twist to be imparted to the yarn passing through the central bore thereof.

In operation, twist timer 87 and valve 86 are periodically operated to provide air under pressure to one or the other of the inputs to the twist jets, thereby imparting twist to the yarn in first one direction and then the other. This portion of the apparatus operates continuously and periodically, regardless of the operation of the remainder of the apparatus shown in FIG. 6.

At the same time, the pressure control timer 75 operates in a timed sequence which does not necessarily have any fixed relationship to the operation of the twist timer. The timing sequence and duration of the pressure control timer operates to sequentially actuate valves 72–74 to provide air to the associated one of pressure regulators 80–82 for the purpose of varying the air pressure supplied to valve 86 and hence to the twist jets, thereby varying from time to time the amount of twist imparted by each of the twist jets to the yarn passing therethrough. Timer 75 can be designed so that it actuates a different one of valves 72–74 and therefore provides a different pressure to valve 86 each time twist timer actuates valve 86, thereby causing each successive segment of twist in the yarn to be different from the preceding segment. However, this relationship need not exist, and the pressure changes can be caused to occur at other times during the twist sequence.

Figure 7:
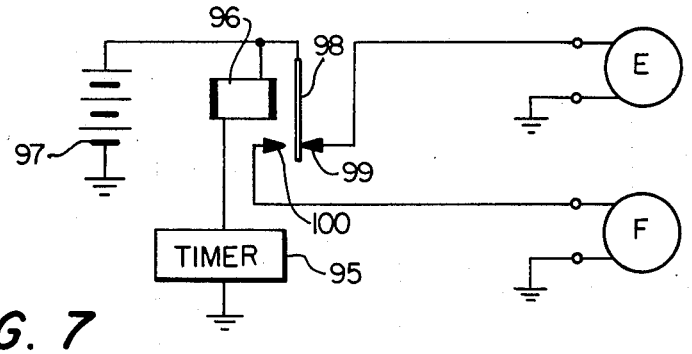
FIG. 7 is a schematic diagram, partly in block form, of a timing circuit usable in accordance with the invention.

A simple timer usable as timer 87 usable with a two-solenoid valve is shown in FIG. 7 wherein a timing circuit 95 periodically completes and opens a circuit for the energizing winding 96 of a solenoid, the other side of the solenoid being connected to a source of voltage indicated by a battery 97. The movable contact 98 operated by winding 96 thus moves between fixed contacts 99 and 100 to connect battery 97 to one or the other of windings E and F which each operate a valve occupying the position of valve 86 in FIG. 6. The valves are fed from separate air sources at different pressures.

Figure 8:
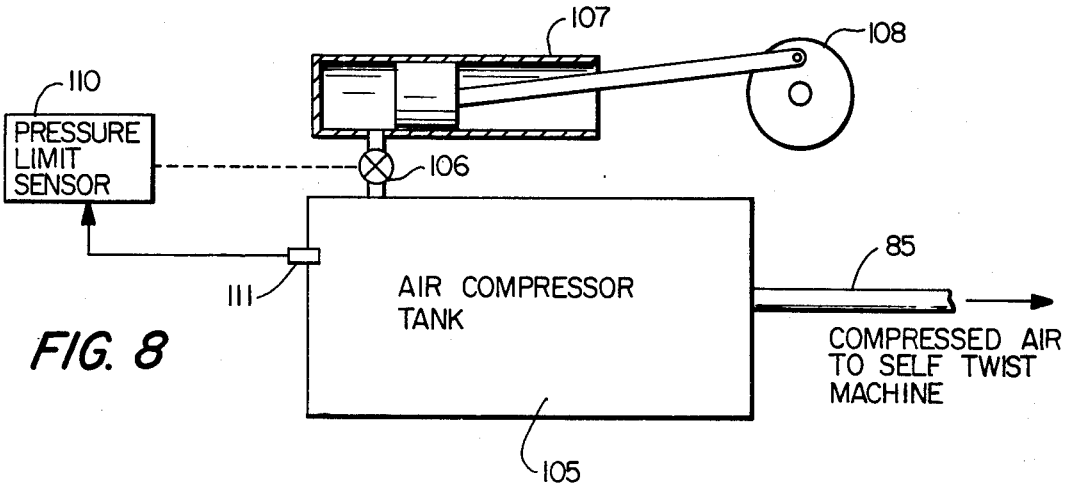
FIG. 8 is a schematic illustration of a further embodiment of an apparatus in accordance with the invention.

A further embodiment of the invention is illustrated in FIG. 8 wherein an air compressor tank 105 is connected to conduit 85 leading to the twist reversal valve 86 or its equivalent. Compressor tank 105 is connected through a conduit and valve 106 to a compressor which is schematically illustrated as including a piston and cylinder structure 107 driven by a fly wheel 108 and a motor, not shown. Valve 106 is operated between open and closed positions by a pressure limit sensor 110 which receives an input signal from a pressure measuring device 111 attached to tank 105. The pressure limit sensor can be selected to close the valve when the pressure in tank 105 has reached an upper pressure limit V1 and, if desired, to simultaneously deenergize the motor driving the piston and cylinder assembly. At this point, the pressure in tank 105 is at the highest desired pressure. Air is continuously being delivered from the tank through conduit 85 and through a twist reversal valve equivalent to valve 86 of FIG. 6 to the twist jets. Thus, with valve 106 closed, the pressure in tank 105 decreases as a function of time. When the pressure in tank 105 reaches a predetermined lower pressure limit V2, sensor 110 again opens the valve and energizes the compressor, causing the pressure in tank 105 to begin increasing, this increase continuing until the pressure therein again arrives at V1, at which time the cycle repeats. Thus, the pressure supplied to the twist jets continuously varies in a somewhat linearly fashion upwardly and downwardly, thereby causing continuous variation in the degree of twist imparted to the yarn passing through the twist jets. As an example the pressures V1 and V2 can be in the order of 100 psig and 50 psig, respectively.

With apparatus such as disclosed herein, when a multiplicity of yarns produced by this apparatus is incorporated in a carpet, the range of twists of the yarns will have a sufficient part of the twist range in common with its neighbors so as to minimize the streak problem. Using the pressures given herein by way of example, a range of amounts of twist in the singles yarns between about 5 turns per inch (tpi) and 9 tpi can be obtained. With nodes spaced apart equally at distances of about 15 inches from each other in the plied yarn, the plied yarn formed from singles yarns having the above twist range exhibits a twist range of between about 3 tpi and 5 tpi.

While certain advantageous embodiments have been chosen to illustrate the invention, it will be understood by those skilled in the art that various changes and modifications can be made therein without departing from the scope of the invention as defined in the appended claims.

What is claimed is:

1. In a yarn of the type having a plurality of false-twisted singles yarns self-twisted together to form a plied yarn with longitudinally spaced nodes of zero twist defining longitudinally distinct plied yarn segments, the improvement wherein the amount of self-twist differs from segment to segment along the plied yarn over a predetermined range of amounts of twist, said self-twist in longitudinally successive segments having opposite twist directions, and said segments which have a same direction of twist having equal lengths and randomly different amounts of twist.

2. A yarn according to claim 1 wherein the longitudinal distances between nodes are substantially equal to each other.

3. A yarn according to claim 2 wherein the amount of self-twist varies over a range of between about 2 tpi and 8 tpi.

4. A plurality of yarns according to claim 3 in combination with a carpet backing, said yarns projecting through spaced points in the carpet backing to provide a plurality of mutually adjacent carpet piles.

5. A plurality of yarns according to claim 2 in combination with a carpet backing, said yarns projecting through spaced points in the carpet backing to provide a plurality of mutually adjacent carpet piles.

6. A plurality of yarns according to claim 1 in combination with a carpet backing, said yarns projecting through spaced points in the carpet backing to provide a plurality of mutually adjacent carpet piles.

* * * * *